United States Patent [19]

Chen et al.

[11] 4,294,010

[45] Oct. 13, 1981

[54] ROTATABLE SAFETY RAZOR AND BLADE CARTRIDGE THEREFOR

[75] Inventors: Evan N. Chen, Fairfield; Frank A. Ferraro, Trumbull, both of Conn.

[73] Assignee: Warner-Lambert Company, Morris Plains, N.J.

[21] Appl. No.: 152,901

[22] Filed: May 23, 1980

[51] Int. Cl.[3] ..... B26B 19/14

[52] U.S. Cl. ..... 30/42; 30/50; 30/346.57

[58] Field of Search ..... 30/42, 43.4, 50, 346.5, 30/346.57

[56] References Cited

U.S. PATENT DOCUMENTS

| | | | |
|---|---|---|---|
| 1,436,960 | 11/1922 | Jakubiec | 30/42 |
| 2,281,531 | 4/1942 | Casner | 30/43.4 |
| 3,568,313 | 3/1971 | Hutter | 30/42 X |
| 4,180,906 | 1/1980 | May | 30/42 |

FOREIGN PATENT DOCUMENTS

| | | | |
|---|---|---|---|
| 391895 | 3/1924 | Fed. Rep. of Germany | 30/42 |
| 1301268 | 8/1969 | Fed. Rep. of Germany | 30/43.4 |

*Primary Examiner*—Gary L. Smith
*Attorney, Agent, or Firm*—R. S. Strickler

[57] ABSTRACT

An electrically-powered, rotary razor is provided for releasably mounting and driving a blade cartridge generally of the safety razor type. The razor delivers a close wet shave with the omnidirectional cutting characteristics of a rotary dry-type shaver.

19 Claims, 6 Drawing Figures

ROTATABLE SAFETY RAZOR AND BLADE CARTRIDGE THEREFOR

BACKGROUND OF THE INVENTION

The invention relates generally to rotatable razors and specifically to a rotatable safety razor and a blade cartridge therefor.

Two general types of shaving are commonly practiced, dry shaving and wet shaving. Traditionally, electric shavers of either the rotary type or the reciprocating type are used for dry shaving. Moreover, the shaver's cutters are separated from the skin and whiskers by a facial guard such that the whiskers are removed by shearing action and the closeness of such shearing is generally limited to the thickness of the facial guard.

The safety razor is typically used for wet shaving and is operated manually. Safety razors have been generally capable of providing closer shaves because the absence of a facial guard permits intimate contact between the blade edge and the hair or whiskers to be shaved. However, the manual stroking operation of safety razors may present some difficulty in fully shaving whiskers which extend in random directions.

It is therefore a principal object of the present invention to provide a razor which affords the omnidirectional cutting characteristics of some electric razors while providing the shaving closeness generally characteristic of a safety razor.

It is a further object of the present invention to provide a replaceable blade cartridge suitable for use in the razor identified in the preceding object.

SUMMARY OF THE INVENTION

In accordance with the present invention there is provided a rotatable safety razor and blade cartridge therefor for overcoming the aforementioned disadvantages of either conventional dry electric shavers or wet safety razors. An electrically-powered, rotary razor is provided for releasably mounting and driving a blade cartridge generally of the safety razor type which delivers a close wet shave with the omnidirectional cutting characteristics of a rotary dry-type shaver.

The razor comprises a housing, preferably of water-resistant design, a rotary electrical motor in the housing, means for controllably supplying electrical energy to the motor, and rotary drive means operatively connected to the motor for receiving rotary driving energy therefrom and transmitting it to a rotatable safety razor cartridge in releasable engagement therewith. The rotary drive means preferably includes a drive spline for engagement with a splined recess in the safety razor cartridge, which drive spline is mounted in the razor housing for resilient axial displacement relative thereto. Moreover, the motor is preferably a DC motor having a no-load speed greater than about 4000 RPM, and the rotary drive means also includes a speed reduction mechanism which drives the drive spline and which accomplishes a speed reduction from said motor of at least about 9:1 in a single step and utilizing only two parallel drives.

The safety razor cartridge comprises a circular blade supporting member, preferably of plastic, a plurality of arcuate grooves concentrically formed in the supporting member about a central axis, the grooves forming a plurality of concentric skin-engaging lands, and at least one, and preferably three, razor blades connected to the supporting member and extending through the grooves and lands with a cutting edge positioned for engaging the skin of a user, and means, preferably a splined recess, for engaging the supporting member with the appropriate rotary drive mechanism of a rotary razor. The widths of at least two of the grooves differ from each other, with the radially outermost being the narrowest, preferably about 0.040 inch, and the radially innermost being the widest, preferably about 0.080 inch, such that the width of the grooves is generally a function of the inverse of the distance of the groove from the central axis. The width of each land may be about 0.020 inch.

The cutting edge of each blade is positioned in close proximity to the respective lands through which it extends and is fixedly mounted on the upwardly inclined underside of a respective mounting member which extends substantially radially through the grooves and lands. The blade exposure, measured relative to a plane tangent to a skin-engaging surface of the mounting member and to the skin-engaging surfaces of the lands, is preferably in the range of 0.000 to −0.002 inch.

DESCRIPTION OF THE PREFERRED EMBODIMENTS

Figure 1:
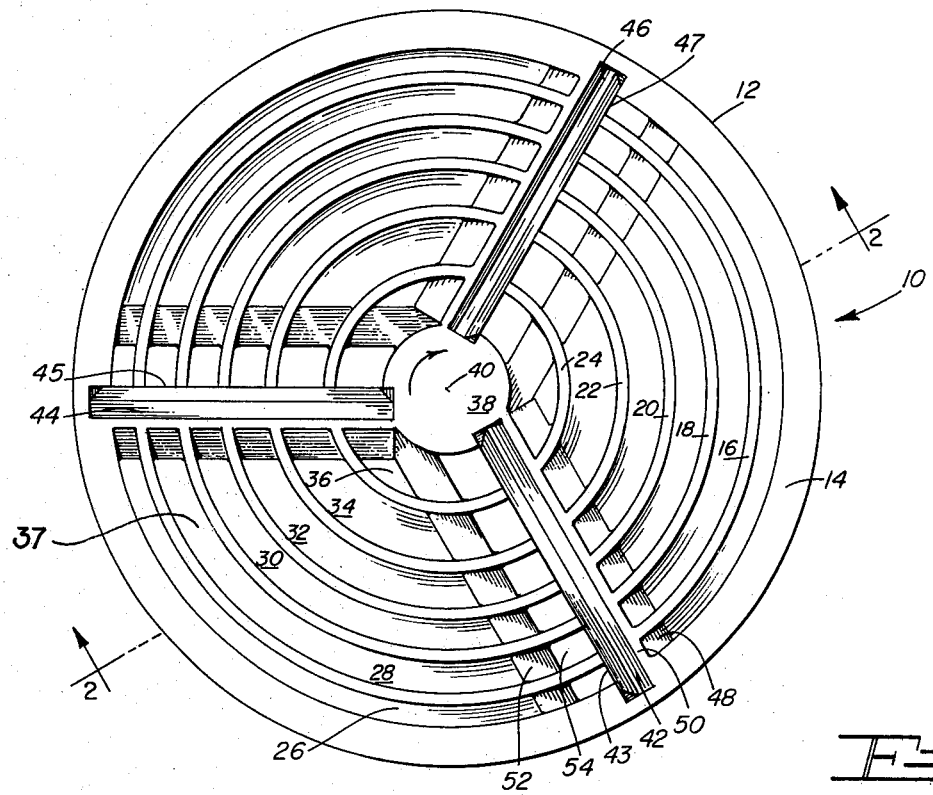
FIG. 1 is a top plan view of a replaceable safety razor blade cartridge in accordance with the present invention.
Figure 2:
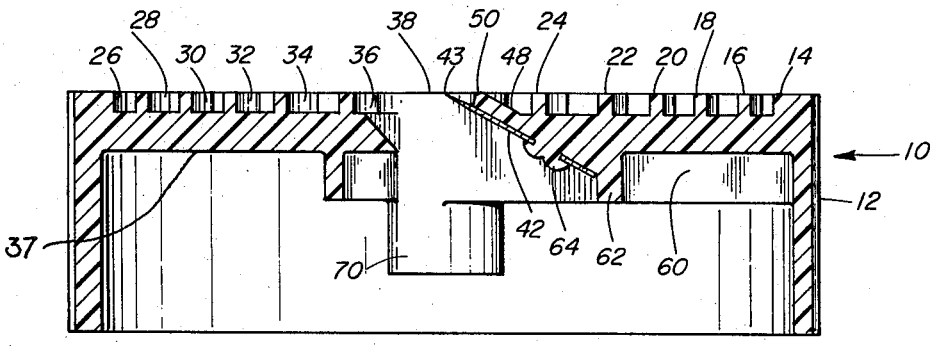
FIG. 2 is a cross-sectional view of the cartridge of FIG. 1 taken along lines 2—2 thereof.
Figure 3:
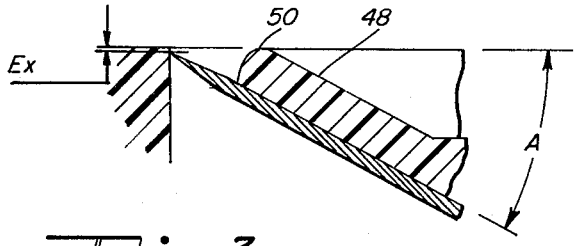
FIG. 3 is a magnified cross-sectional view of a part of the cartridge of FIG. 1 taken along lines 3—3 thereof.
Figure 4:
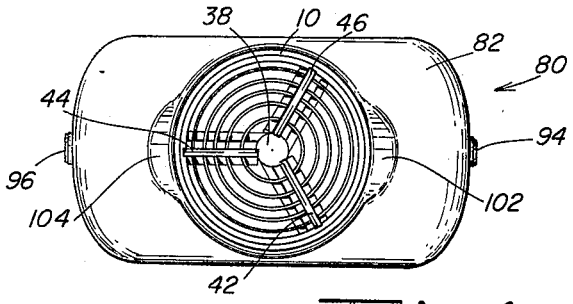
FIG. 4 is a top plan view of a razor in accordance with an aspect of the present invention including the cartridge of FIG. 1.
Figure 5:
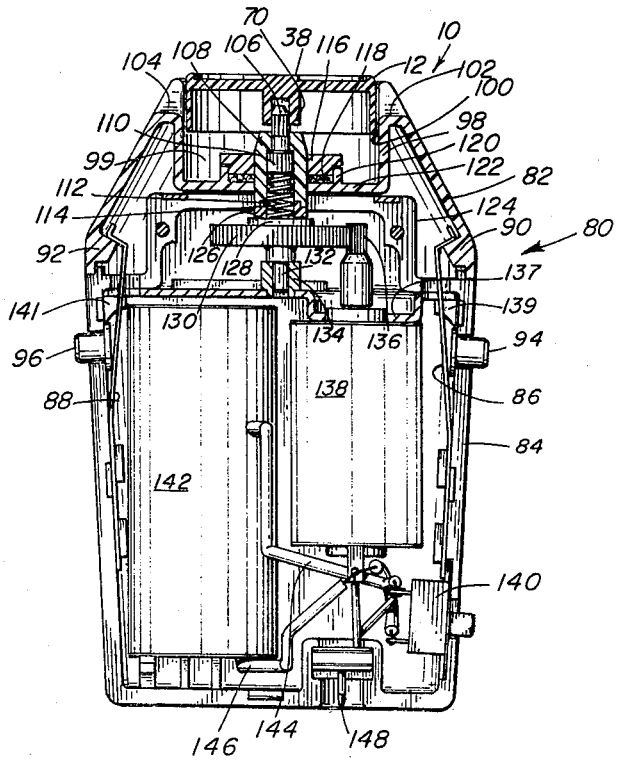
FIG. 5 is a side elevational view of the razor and cartridge of FIG. 4 with the side wall removed, and the cartridge and upper drive mechanism portions shown in cross-section.
Figure 6:
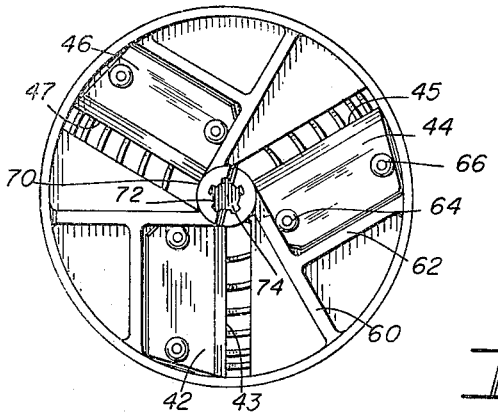
FIG. 6 is a bottom plan view of the cartridge of FIG. 1.

Referring to FIGS. 1, 2, 3 and 6, there is illustrated a replaceable safety razor blade cartridge 10 for use in an electric rotary razor 80 illustrated in FIGS. 4 and 5. The razor blade cartridge 10 consists of a plurality, in this instance three, safety razor blades 42, 44 and 46 respectively mounted in a unitary plastic supporting framework consisting of an annular rim or skirt 12 concentrically surrounding a central hub 38 and spaced therefrom by means of three generally radially extending, equiangularly spaced arms or spokes 48 which additionally provide the mounting surfaces for blades 42, 44 and 46. Each of the blades 42, 44 and 46 herein is about one-half inch in length.

Intermediate the rim 12 and the hub 38 there are formed a plurality, in this instance six, arcuate lands 14, 16, 18, 20, 22 and 24 respectively. Lands 14–24 are concentrically spaced about a central axis 40 passing through the center of hub 38. Each of the lands 14–24 is radially spaced from the others such as to form therebetween respectively arcuate grooves 26, 28, 30, 32, 34 and 36 respectively, also concentric with axis 40. The spokes 48 integrally interconnect with each of the lands 14–24 and have a common upper surface, herein designated 50, which extends substantially radially of hub 38 and defines a skin-engaging surface analogous to that of a cap in a conventional safety razor cartridge.

Downwardly recessed from the upper surfaces and forming the connecting base of the lands 14–24 are three arcuate plastic webs 37 which serve to strengthen the blade cartridge 10. Further reinforcement is provided to the webs 37 by radial reinforcing ribs 60 and transverse reinforcing ribs 62 integrally molded therewith and extending downwardly therefrom.

A small gap exists between the skin-engaging surface 50 of arms 48 and the ends of the immediately preceding array of concentric lands 14–24. Within this gap is positioned the cutting edge 43 of each of the respective razor blades 42, 44 and 46. Further, the undersurface of each of the arms 48 is inclined upwardly at a preferred shaving angle, for instance 26°, relative to a plane tangent to the skin-engaging surface 50 of arm 48 and the skin-engaging surface of the respective lands 14–24. The blades 42, 44 and 46 are seated against the undersurface of a respective arm 48 and are fixedly secured thereto as by means of a pair of staking posts 64 and 66 which extend through corresponding holes in the blades and subsequently have their heads flared in a known manner to maintain the blades in position. The blades 42, 44 and 46 are positioned such that the respective cutting edges 43 extend to the trailing edges of the preceding lands 14–24 and, vertically, are within a range extending from a plane tangent to the skin-engaging surfaces 14–24 and the skin-engaging surface 50 of arm 48 downwardly to a position about 0.002 inch below that plane. This distance of the cutting edge 43 below the tangent plane is commonly referred to as the blade exposure, designated Ex in FIG. 3 and thus is typically in the range of 0.000 to −0.002 inch. This neutral or slightly negative exposure, in combination with the radial dimensioning of the respective grooves 26–36 to be discussed hereinafter in greater detail, affords both a close and a safe shave.

Each support web 37 which underlies and forms the base for the arcuate lands 14–24 and grooves 26–36 between each of blades 42, 44 and 46 is continuous except for a relatively narrow, i.e., 0.100 inch, radially-extending region generally designated 54 immediately in advance of the respective blade edges 43. Within that region 54, the grooves 26–36 extend entirely through the cartridge to its underside, thereby facilitating the flow of shaving lather and debris past and under the respective blades 42, 44 and 46. A trailing portion 52 of each support web 37 is downwardly inclined at an angle substantially parallel to the blades 42, 44 and 46 so as to also facilitate the flow of lather and debris past the respective blades.

A spline housing 70 comprises a downward extension of hub 38 having an opening 74 extending axially upwardly thereinto and provided with a plurality of spline teeth 72 arranged about the inner periphery thereof for rotary force transmitting engagement with the drive spline 106 associated with the razor 80. The diameter of the recess 74 is made slightly smaller than that of the drive spline 106 with which it is to be connected in order to provide an interference fit therewith. A pair of axially extending slots in the side walls of the cartridge spline housing 70 affords the necessary resiliency for engaging the razor drive spline 106.

The width of each of the grooves 26, 28, 30, 32, 34 and 36 is different from that of any other so as to optimize shaving closeness and safety. Specifically, it will be appreciated that the linear velocity of the blade edge 43 increases with the distance from the center axis 40 for any given angular velocity of the cartridge 10, and it is preferable to have the narrowest groove in the region of highest blade velocity and the widest groove in the region of lowest blade velocity. More specifically, it has been determined that a maximum linear blade velocity of about 2 feet per second most nearly corresponds with typical blade velocities of manually operated safety razors and/or conventional electic razors, and such velocity is provided herein for the outer regions of blade edges 43 near groove 26. At such blade velocity, a minimum groove width of about 0.040 inch is required to provide adequate shaving closeness and debris rinsability. Accordingly, the outermost groove 26 has a width of about 0.040 inch. Moreover, it has been determined that even at the relatively low linear velocity of the blade edge 43 near the center axis, the skin-engaging and supporting guard surface provided by the lands in advance of the blade edge should be spaced transversely of the edge no more than about 0.080 inch so as to prevent undue nicking of the user's skin. Accordingly, the innermost groove 36 has a width which is about 0.080 inch.

The remaining four grooves 28, 30, 32 and 34 positioned intermediate grooves 26 and 36 possess widths which are intermediate those of grooves 26 and 36. While each successive one of grooves 28, 30, 32 and 34 respectively might have a larger width than the preceding, it has been found convenient and functionally adequate to make two of those grooves of one width and the other two of another width. Specifically, grooves 28 and 30 each have widths of about 0.048 inch and grooves 32 and 34 each have widths of about 0.060 inch. Thus, it is seen that the width of each groove may be generally said to be a function of the inverse of the distance of that groove from the central axis 40.

Having described the rotatable safety razor cartridge 10, attention is now directed to the electrical rotary razor 80 of FIGS. 4 and 5 in which the cartridge is removably installed. A 2.4 volt DC rotary motor 138 is mounted on a motor mounting bracket 137 which is in turn mounted within a razor housing 84. Razor housing 84 is preferably formed of plastic or the like, may comprise two mating halves, and is sealed to make it substantially water-impermeable. The motor 138 has a no-load speed of at least about 4000 RPM and in the present embodiment is about 5000 RPM. The motor 138 is capable of providing a minimum torque of 3.5 inch-ounce.

Electrical energy is provided to motor 138 by means of rechargeable nickel cadmium batteries 142 electrically connected therewith. Batteries 142 may be recharged via charging terminals 148 and conductors 144 and 146 in a known manner. A switch 140 operatively connected to the charging terminals 148, the conductors 144 and 146, and the motor 138 serves to control the recharging of batteries 142 and/or energization of motor 138.

The rotary output of motor 138 is operatively connected to a rotary drive mechanism which in turn imparts rotary energy to safety razor cartridge 10. Generally speaking, the rotary drive mechanism includes a pinion 136 operatively connected to the output shaft of motor 138, a drive gear 130 in operative engagement with pinion 136, and a drive spline 106 operatively connected to be driven by drive gear 130.

The pinion 136 and drive gear 130 are mounted on parallel drive axes and are of a type capable of providing, in a single stage, a speed reduction of at least 9:1. More specifically, pinion 136 and drive gear 130 comprise a spur gear drive system combined with a helix angle sold under the trademark EVOLOID and available from Quaker City Gear Works of Huntingdon Valley, Pennsylvania 19006, and herein providing a speed reduction of about 10:1 such that the rotary speed of drive pinion 136, and thus the safety razor cartridge 10, is about 500 RPM. Drive gear 130 is press-fitted to or integrally molded with a central drive shaft 132 which is rotatably mounted in bearing 134 which is in turn mounted on motor support bracket 137 centrally of housing 84. A thin circular collar 128 with an upwardly extending annular coupling portion 126 is formed integrally with the upper surface of drive gear 130 and serves as the base support for the drive spline 106 and its housing.

A generally tubular, vertically-extending plunger housing 108, partially closed at its upper end, is ultrasonically bonded at its lower end to coupling portion 126 of collar 128. Plunger housing 108 includes a vertical rectangular inner keyway 112 in which is captively housed rectangular plunger 110 which forms an enlarged base to the drive spline 106. Drive spline 106 extends upwardly from plunger 110 through the opening in the upper end of plunger housing 108. A compression spring 114 is interposed between collar 128 and the underside of plunger 110 so as to bias the plunger into upwardly limited engagement with the top inner surface of plunger housing 108. In this positioning of plunger 110, the drive spline 106 extends sufficiently beyond plunger housing 108 for the spline housing 70 of safety razor cartridge 10 to be operatively positioned thereover. The spring 114 thus serves to bias the safety razor cartridge 10 to a normal upwardly extended position from which it is capable of limited resilient downward deflection against spring 114 in response to shaving forces. Plunger 110 and drive spline 106 rotate with plunger housing 108 which in turn is rotated by drive gear 130.

The lower portion of plunger housing 108 extends through an opening in the upper portion 124 of housing 84 and serves to generally close and seal the upper end of housing 84. A head guard 82 mounts on the upper portion of razor housing 84 and extends upwardly therefrom to support and house the plunger 108 and razor cartridge 10, as well as to further displace and seal the battery 142 and motor 138 from possible contact with water. The head guard 82 includes a central circular cavity 99 formed by an annular side wall 98 and an annular base portion 122 having a central opening through which plunger housing 108 upwardly passes. An annular shaft seal 118 is seated within an annular recess defined by walls 120 and is maintained in close sealing engagement with plunger housing 108 with the aid of an annular bearing flange 116 fastened, by mechanical means or welding, to the head guard 82. The plunger housing 108 and thus drive spline 106 are free to rotate within and relative to bearing flange 116 and head guard 82, yet a substantially watertight seal is maintained by shaft seal 118.

When safety razor cartridge 10 is operatively mounted on drive spline 106, the lower portion of its annular rim 12 extends downwardly into the annular cavity 99 formed in head guard 82. A narrow annular space 100 of about 0.060 inch is maintained between cartridge rim 12 and the side wall 98 of head guard 82 to permit egress of lather, shaving debris and water outwardly through the side of the head guard. A pair of concave depressions 102, 104 in the head guard 82 adjacent opposite sides of the cartridge 10 enable a user to grasp the cartridge 10 with a thumb and forefinger for insertion onto and removal from the drive spline 106.

The head guard 82 fits in mated engagement with an upper perimeter of housing 84 and is maintained in such relationship by a pair of springs 86, 88 mounted on opposite sides of housing 84. The upper ends of springs 86, 88 include generally outwardly and downwardly facing catch surfaces which coact with the upward and inwardly facing shoulders 90 and 92 respectively. Springs 86 and 88 are normally biased into retaining engagement with shoulders 90 and 92 so as to maintain head guard 82 in tightly seated engagement with housing 84. A pair of push buttons 94 and 96 mounted in opposite sides of housing 84 are operative, upon inward actuation, to inwardly displace springs 86 and 88 respectively out of engagement with shoulders 90 and 92 respectively, thereby allowing removal of head guard 82 from housing 84.

To utilize the razor and cartridge of the invention, the cartridge 10 is installed on the razor 80, the skin surface to be shaved is prepared, as with soap lather, and subsequently shaved, thereby employing the combined techniques of wet and dry shaving and obtaining the most desirable results from each.

Additions, deletions and modifications of the preferred embodiment illustrating the invention may be made by those skilled in the art and are within the scope of the invention as defined by the following claims.

We claim:

1. A rotatable safety razor cartridge comprising:

a circular blade supporting member;

a plurality of arcuate grooves concentrically formed in said supporting member about a central axis, said grooves forming a plurality of concentric skin-engaging lands;

at least one razor blade connected to said supporting member and extending through said plurality of grooves and lands with a cutting edge positioned for engaging the skin of a user; and means for engaging said supporting member with a rotary drive mechanism.

2. The razor cartridge of claim 1 wherein the widths of at least two grooves in said plurality of grooves differ from each other.

3. The razor cartridge of claim 2 wherein the width of said grooves is a function of the inverse of the distance of said groove from said supporting member central axis.

4. The razor cartridge of claim 3 wherein all of said lands are of substantially the same width as one another.

5. The razor cartridge of claim 4 wherein the width of each land is about 0.020 inch.

6. The razor cartridge of claim 3 wherein the width of that groove in said plurality of grooves most distant from said supporting member central axis is about 0.040 inch.

7. The razor cartridge of claim 6 wherein the width of that groove in said plurality of grooves closest to said supporting member central axis is about 0.080 inch.

8. The razor cartridge of claim 1 wherein the cutting edge of said at least one razor blade is positioned in close proximity to the respective said lands through which it extends.

9. The razor cartridge of claim 7 wherein said supporting member includes a respective mounting member for each said at least one razor blade, each said mounting member extending through said plurality of grooves and lands substantially radially of said central axis and having a blade-seating undersurface inclined upwardly toward said lands, each said at least one razor blade being in seated engagement with and rigidly connected to the undersurface of a respective said mounting member.

10. The razor cartridge of claim 9 wherein each said mounting member includes an upper skin-engaging surface, and the cutting edge of each said razor blade is positioned within a range extending from a plane tangent to the skin-engaging surfaces of said lands and said mounting member to a position about 0.002 inch below said plane.

11. The razor cartridge of claim 1 wherein said blade supporting member is formed of plastic.

12. The razor cartridge of claim 1 wherein said rotary drive mechanism engaging means comprises a splined recess concentric with said central axis and formed in the underside of said supporting member.

13. The razor cartridge of claim 1 wherein said at least one razor blade comprises three razor blades equiangularly positioned about said central axis.

14. An electrically-powered rotary safety razor comprising:

a housing;

a rotary electrical motor in said housing;

means for controllably supplying electrical energy to said motor;

rotary drive means operatively connected to said motor for receiving rotary driving energy therefrom; and a rotatable safety razor cartridge operatively connected to said rotary drive means for receiving the rotary driving energy therefrom provided by said motor, said razor cartridge comprising a circular blade supporting member; a plurality of arcuate grooves concentrically formed in said supporting member about a central axis, said grooves forming a plurality of concentric skin-engaging lands; at least one razor blade connected to said supporting member and extending through said plurality of grooves and lands with a cutting edge positioned for engaging the skin of a user; and means for engaging said blade supporting member with said rotary drive means whereby to impart said rotary driving energy to said supporting member.

15. The rotary safety razor of claim 14 wherein said means for engaging said safety razor cartridge with said rotary drive means is releasable.

16. The rotary safety razor of claim 15 wherein said rotary drive means include a drive spline and said safety razor cartride includes a splined recess concentric with said central axis for releasable connection with said razor drive spline.

17. The rotary safety razor of claim 16 wherein said razor drive spline is mounted for resilient axial displacement relative to said razor housing thereby to resiliently mount said safety razor cartridge relative to said razor housing.

18. The rotary safety razor of claim 14 wherein said motor is a DC motor having a no-load speed greater than about 4000 RPM and said rotary drive means comprises a speed reduction mechanism for reducing the speed of the rotary energy transmitted from said motor to said safety razor cartridge by a ratio at least as great as about 9:1.

19. The rotary safety razor of claim 18 wherein said speed reduction mechanism comprises only two parallel drives and accomplishes said reduction in a single step.

* * * * *